US006318115B1

(12) United States Patent
Kirchner et al.

(10) Patent No.: US 6,318,115 B1
(45) Date of Patent: Nov. 20, 2001

(54) REFRIGERATION CIRCUIT AND APPARATUS

(75) Inventors: Jorg Kirchner, Lipprechterode; Jürgen Schenk, Dresden; Monika Knabe, Radebeul; Jürgen Voigt, Dresden, all of (DE)

(73) Assignee: Kenmore Thermokälte GmbH, Bleicherode (DE)

( * ) Notice: Subject to any disclaimer, the term of this patent is extended or adjusted under 35 U.S.C. 154(b) by 0 days.

(21) Appl. No.: 09/566,313

(22) Filed: May 8, 2000

(51) Int. Cl.[7] ..... F25B 43/00
(52) U.S. Cl. ..... 62/474; 62/292
(58) Field of Search ..... 62/474, 475, 498, 62/292, 195; 210/DIG. 6, DIG. 7, 287

(56) References Cited

U.S. PATENT DOCUMENTS 4,745,772 * 5/1988 Ferris ..... 62/292
6,044,649 * 4/2000 Numoto et al. ..... 62/474 X

FOREIGN PATENT DOCUMENTS 195 45 791 6/1997 (DE) .
297 14 545 9/1997 (DE) .
198 00 739 8/1998 (DE) .
05141814-A * 6/1993 (JP) .

* cited by examiner

*Primary Examiner*—Henry Bennett
*Assistant Examiner*—Chen-Wen Jiang
(74) *Attorney, Agent, or Firm*—Collard & Roe, P.C.

(57) ABSTRACT

A refrigerating circuit having a condenser and an evaporator, wherein shaped bodies (9, 9*a*) of a drying agent are arranged within a component (6), which carries liquid refrigerant of the circuit, and are so adapted to the internal geometric shape of the respective component as to filter residual moisture from throughflowing refrigerant.

18 Claims, 1 Drawing Sheet

REFRIGERATION CIRCUIT AND APPARATUS

BACKGROUND OF THE INVENTION

1. Field of the Invention

The present invention relates to an improved refrigerating circuit

2. The Prior Art

The refrigerant drying path, which is incorporated in a closed refrigerating circuit, and which is usually designed as a filter and conducts liquid refrigerant, has the task of extracting any residual moisture and possible fine dirt particles and abrasion particles of the drying means from the liquid refrigerant in order to insure dryness and stability of the circuit.

In the case of known refrigerating circuits, the refrigerant drying path is formed by a separate drier or filter-drier, which is incorporated into the closed circuit by soldering, or by a fluid-tight connection, and has a capillary or expansion valve disposed upstream of a flow throttle point with respect to the flow direction of the liquid refrigerant.

These driers or filter-driers essentially consist of a housing in which a drying means and a sieve, are provided downstream of the drying means in the flow direction of the refrigerant. One end of the housing is matched to the diameter of the pipe of the condenser, and the other end is matched to the diameter of a capillary or an expansion valve connected thereto.

This mode of construction of the drier, which is commonly used in a refrigerating circuit for a refrigerating and freezing appliance with a rear wall condenser, is expensive to produce. This is due to the housing requiring an increased diameter and a consequent narrowing at the inlet and outlet ends to match, respectively, the diameter of the pipe of the rear wall condenser, and the diameter of the capillary. Moreover, connecting the drier with the condenser pipe and the capillary is an expensive step, which has to be carried out with particular care in order to avoid impairment of the circuit. In the case of driers of that kind, the inlet end and the outlet end must be closed securely after manufacture and until assembly in order to prevent an ingress of air moisture or small dirt particles so as to ensure full effectiveness of the drier after incorporation into the refrigerating circuit. The ingress of small dirt particles and moisture into the drier before incorporation into the circuit would also significantly impair the dryness and stability of the circuit.

In German patent DE 297 14 545 U1, there is disclosed a refrigerating circuit in which the drying means is introduced in the form of loose material into an enlargement of the pipe. This pipe carries the liquid refrigerant of the rear wall condenser, which is separated by a sieve from the adjoining capillary, or is inserted as a filter cartridge, which is to be filled with drying means with a filter sieve. Although additional incorporation of a drier can be dispensed with for a refrigerating circuit of that kind, and the disadvantages connected therewith can almost be excluded, the enlargement of the pipe of the rear wall condenser is expensive. Moreover, the production effort and care during the assembly, for example during the soldering of the capillary, continue to be required, so that costs can not be substantially improved using this refrigerating circuit.

In known refrigerating circuits of a larger stationary refrigerating plant, the filter drier, which is added to the refrigerating circuit, consists of a housing containing solid bodies of filter drying agent, which are produced as pressed sintered bodies of a filter drying agent. These solid bodies, also known as filter drying cartridges, are clamped together by special fastening equipment so that they are flowed through in succession by refrigerant within the housing of the filter drier. The fastening equipment, wherein the filter drying cartridges must be connected together and mounted within the housing, are relatively expensive. The length of this fastening equipment must be matched to the number of the filter drying cartridges used. Consequently, an associated fastening equipment must be kept in reserve for each filter drier of a certain capacity.

Moreover, the drier must be protected against the ingress of moisture and dirt particles by closing the entry and exit openings up to its time of assembly into the refrigerating circuit.

A refrigerating circuit for an air-conditioning plant with a condenser, in which drying means equipment in the form of a filter cartridge for integration within the condenser in the flow path of the refrigerant, is known from German patent DE 198 00 739. This filter cartridge consists of a filter drying means which, similarly as for a drier, is introduced into a cylindrical projection of a housing, which is capable of being screwed into place. The thus-formed drying equipments is inserted into the liquid refrigerant flow of a collecting pipe of the condenser. This refrigerating circuit, due to the additionally insertable drying equipment, has almost the same disadvantages as outlined for the preceding refrigerant circuits. Due to the formation of the condenser with deflecting stages, the length of the drying equipment and thus the surface of the drying means flowed across by liquid refrigerant is limited, whereby the dryness and the stability of the circuit can be impaired.

There is therefore a need to improve such refrigerating circuits so that the effectiveness of the circuit can be increased by using a component carrying liquid refrigerant, and a separate component, which is to be incorporated into the circuit, with a drying or filtering function that can be dispensed with, so that manufacturing and assembly costs can be reduced.

SUMMARY OF THE INVENTION

Accordingly the present invention provides a refrigerating circuit with a condenser and an evaporator, wherein shaped bodies of a drying agent are disposed within the circuit components, that carry liquid refrigerant, and fit into the internal geometric shape of the respective components. This construction of the refrigerating circuit insures that the liquid refrigerant can be dried while the liquid refrigerant flows through the components in the circuit. Consequently, it is possible to dispense with an additional drier without impairing the dryness and stability of the circuit, which are critical for the performance of the associated refrigerating system. Consequently, the costs for construction of the refrigerating circuit can be reduced by eliminating the separate drier, and the refrigeration circuit can operate more economically.

Preferably, a sieve is provided in the component which carries liquid refrigerant in the flow direction of the refrigerant behind the molded body. This sieve can advantageously be a sintered body. It is ensured by this sieve that, on the one hand, the molded bodies are fixed in position in flow direction of the refrigerant and, on the other hand, possible solid particles, which are entrained by the refrigerant flow, are filtered out of the refrigerant in order to prevent the throttle point, for example a capillary or an expansion valve from clogging.

In a further preferred embodiment, the molded bodies are bent in meander shape, and inserted into a straight region of the component. Thus, in the case of a component constructed as rear wall condenser, this region can be that portion of the component in the flow direction of the refrigerant which is adjoined by the capillary or expansion valve. Thereby, molded rods can be inserted without difficulty, one after the other into the pipe of the rear wall condenser, so as to substantially simplify the assembly of the refrigerating circuit. Moreover, this circuit construction is more compact which is advantageous for transportation.

Moreover, the molded body is elongated, having a diameter which is greater than half the internal diameter of the component. The external outline of the molded body can be freely selectable even when several molded bodies are pushed sequentially into the component carrying the liquid refrigerant. Thus, the greatest possible area of the molded bodies of drying agent are exposed to, for example due to without having any disturbances in the stability of the circuit even though the refrigerant flows past the pushed-in molded bodies which overlie one another at their longitudinal sides.

It is advantageous for larger refrigerating circuits if the molded bodies each consist of a molded part of hollow cylindrical shape having a wall thickness which is less than half the internal diameter of the component, and an external diameter which is smaller than the internal diameter of the component. Thus, the area of the molded bodies flowed around by refrigerant can be increased in the case of systems with a greater volume flow of refrigerant. Due to the proposed dependence of the wall thickness of the hollow cylindrical molded body on the internal diameter of the component, the drying agent used for the forming of the molded bodies provides for the drying function, and thereby for the drying and stability of the circuit.

It is also advantageous if the connection between the throttle point, for example expansion valve, and the component is detachable, especially in the case of larger refrigerating systems, so that the molded bodies are exchangeable. It is recommended that the molded bodies be provided with a thin wire so that they can be easily drawn out of the circuit for purposes of renewal. Thus, larger stationary refrigerating systems can be equipped with a refrigerating circuit embodying the invention, particularly systems likely to have a service life far beyond the service life of the molded bodies.

BRIEF DESCRIPTION OF THE DRAWINGS

Other objects and features of the present invention will become apparent from the following detailed description considered in connection with the accompanying drawing. It is to be understood, however, that the drawing is designed as an illustration only, and not as a definition of the limits of the invention.

In the drawing, wherein similar reference characters denote similar elements throughout the several views.

DETAILED DESCRIPTION OF THE PREFERRED EMBODIMENT

Figure 1:
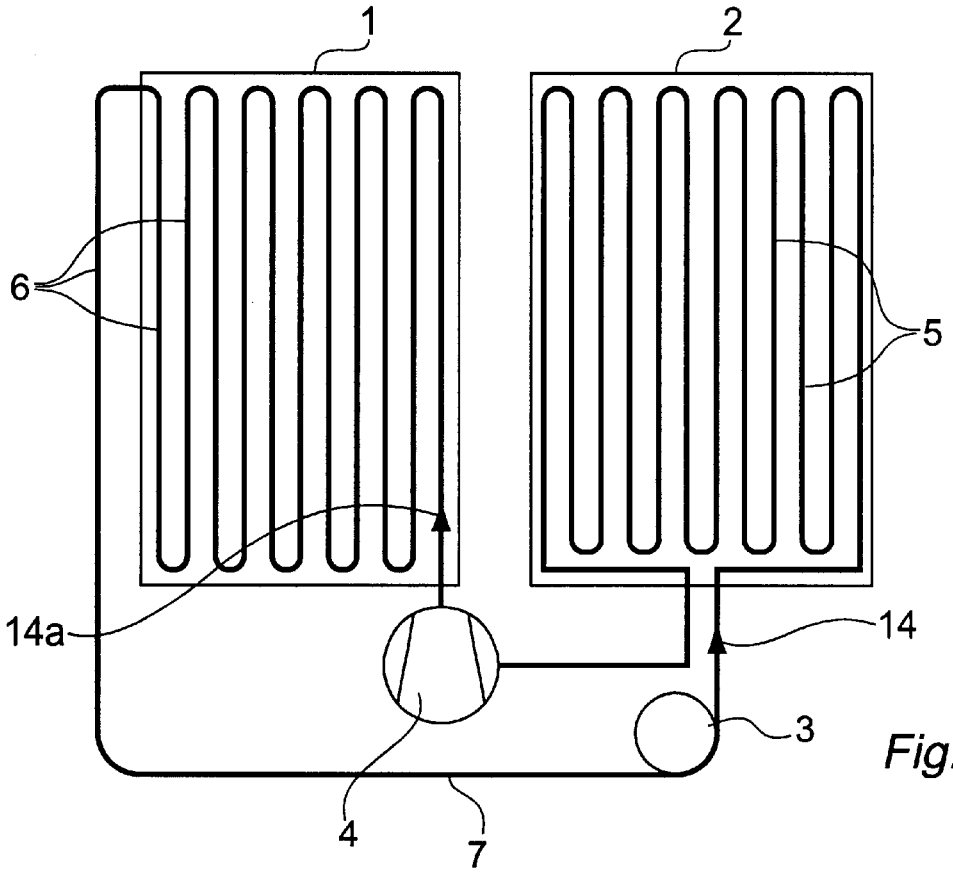
FIG. 1 shows a schematic view of a refrigerating circuit embodying the invention, with a rear wall condenser.

Referring now in detail to the drawings and, in particular, FIG. 1 there is shown the refrigeration circuit of a refrigerating and/or freezing appliance having a throttle, for example a capillary 3, an evaporator 2, a compressor 4 and a condenser 1, which is constructed as a rear wall condenser.

As shown in FIG. 1, condenser 1 and evaporator 2 each consist of a pipe bent into meander shape, denoted in the following as components 5 and 6. Each pipe is securely connected, for example, by a soldered connection, in a liquid-tight and air-tight manner at one end with compressor 4 and at the other end with capillary 3.

Figure 2:
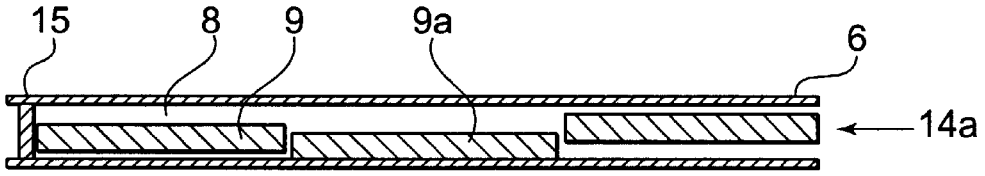
FIG. 2 shows an enlarged longitudinal sectional view of a component of the circuit of FIG. 1, with shaped bodies of a drying agent.

Loosely arranged in component 6, which carries liquid refrigerant, are one or more shaped or molded bodies 9, 9*a* or 11 of a drying agent, as shown in FIG. 2. These bodies are flowed around or through and around, while in flotation, by the flow of liquid refrigerant through component 6. In that case, residual moisture is extracted from the liquid refrigerant, so that the dryness and stability of the circuit are ensured, and a high degree of dynamic drying is achieved.

A fine-mesh sieve 15, which arrests the bodies pushed into component 6 in the flow direction 14*a* of the refrigerant, is pressed in behind the bodies in the flow direction. Sieve 15 also filters possible contaminants, which can consist of abrasion particles of bodies 9, 9*a* or 11 from the refrigerant. It is advantageous if sieve 15 is a sintered body which can, as is known, be manufactured with a very small pore size and is thereby capable of filtering out even small contaminants from the refrigerant so that a risk of clogging of the capillary 3 can be largely excluded.

Figure 3:
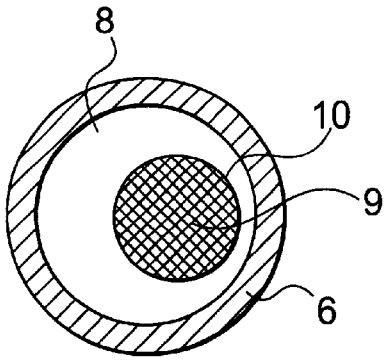
FIG. 3 shows a cross-section, to a further enlarged scale of the component with one of the shaped bodies, of solid form; and, FIG. 4 shows a cross-section similar to FIG. 3, but showing a shaped body of hollow cylindrical form.

Bodies 9, 9*a* or 11 consist of elongated cylindrical molded pieces, the external diameter 10 of which is greater than half the internal diameter 8 of component 6 as shown in FIG. 3. It is advantageous if external diameter 10 is less than 85% of internal diameter 8 of component 6. In this manner, the bodies are prevented from sliding past one another at their longitudinal sides. Consequently, a reduction in the contact area of the liquid refrigerant with the bodies or a cross-sectional constriction in the throughflow region can be excluded. At the same time, an adequate free gap between internal diameter 8 of component 6 and the external diameter of the bodies is formed for the flowing refrigerant, so that the full effectiveness of the drying function of the bodies is ensured.

Figure 4:
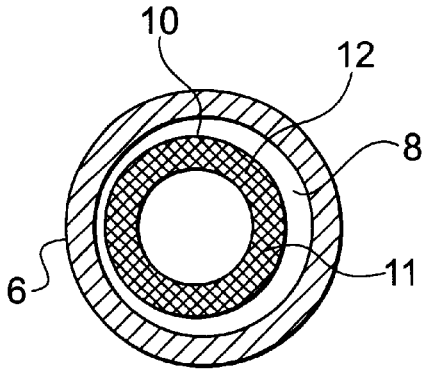

In order to increase the contact area of the liquid refrigerant with the drying agent, it is advantageous, particularly in the case of larger refrigerating circuits designed with a greater internal diameter 8 of components 6, if bodies 11 of hollow cylindrical shape are used, as shown in FIG. 4. In order that the deployed quantity of drying agent of the bodies can be included completely in the drying of the refrigerant, it is advantageous if the wall thickness 12 of body 11 be less than half the internal diameter 8 of component 6. Preferably, wall thickness 12 should not be greater than 40% of the internal diameter 8 of component 6.

The external profile of bodies 9, 9*a* or 11 can be chosen. as freely as desired, and is not limited to the outlines illustrated in FIGS. 3 and 4, provided that the preferred interdependency of the diameters of component 6 and the bodies is observed. The same applies to the internal profile of body 11.

Preferably, the drying agent of which bodies 9, 9*a* or 11 are made of consists of a molecular sieve as its main component.

In the case of a large refrigerating system, in order to provide the circuit with a long service life, which, as a rule, should be greater than the time for saturation of the drying agent of bodies 9, 9*a* or 11, the connection between component 6 and the throttle can, for example, be constructed to be detachable so that the bodies are accessible for the purpose of exchange. It is recommended that during replacement, the bodies have a fine, firmly connected wire, that can be readily removed from component 6 after removal of sieve 15.

Appropriate suitable detachable connections or couplings can also be provided within component 6 when molded bodies 9, 9*a* or 11 are to be provided in a region of the circuit which does not correspond with portion 7 of component 6 where throttle 3 directly connects, provided that a form of connection is chosen which ensures the dryness and the stability of the circuit.

The bodies can also be disposed in other regions of a component carrying a liquid refrigerant. This can, inter alia, contribute to a further improvement in the dryness and stability of the circuit and thereby the dynamic drying.

The flow direction 14, of the gaseous refrigerant in component 5 of evaporator 2 is shown in FIG. 1 exclusively for completion of the circuit.

Accordingly, while only a few embodiments of the present invention have been shown and described, it is obvious that many changes and modifications may be made thereunto without departing from the spirit and scope of the invention.

What is claimed is:

1. A refrigerating circuit having a condenser component part 6, and an evaporator component part 5 with a refrigerant pump for pumping refrigerant and connected at the input of the condenser component part 6, and a throttle point 3 connected to the input of evaporation component part 5 comprising;

at least one body of drying material disposed in the refrigerant flow path of the condenser component part of the circuit, said body having a shape adapted to the internal geometric shape of the condenser component part so that the drying material of said body has a drying effect on moisture in the refrigerant flowing in the condenser component part.

2. The circuit as claimed in claim 1, comprising a filter arranged in the condenser component part downstream of the body with respect to a given direction of flow of refrigerant along the path.

3. The circuit as claimed in claim 2, wherein the filter is an element of sintered material.

4. The circuit as claimed in claim 1, wherein said at least one body comprises a molecular sieve.

5. The circuit as claimed in claim 1, wherein the condenser component part defines a straight section of the flow path, and a curved section of the flow path, and said at least one body is disposed in the straight section.

6. The circuit as claimed in claim 1, wherein said at least one body is disposed in a section of the flow path adjoining the throttle point of the circuit.

7. The circuit as claimed in claim 1, wherein said at least one body is elongated and has an external diameter smaller than the diameter of the flow cross-section of the path, but greater than half the diameter of that cross-section.

8. The circuit as claimed in claim 1, wherein each of said body is tubular and has a wall thickness less than half the diameter of the flow cross-section of the path, and an external diameter smaller than the diameter of that cross-section.

9. The circuit as claimed in claim 1 wherein said at least one body comprises a plurality of bodies inserted loosely into the condenser component part so as to be disposed one after the other into the flow path of refrigerant.

10. The circuit as claimed in claim 9, wherein said plurality of bodies have respectively different external outlines in cross-section. flow point.

11. The circuit as claimed in claim 1, comprising connecting means disposed in the flow path and openable to permit removal of said at least one body from the flow path.

12. The circuit as claimed in claim 1, wherein the flow path is not straight.

13. A refrigeration apparatus comprising a circuit having a condenser component part 6, and an evaporator component part 5 with a refrigerant pump for pumping refrigerant and connected at the input of the condenser component part 6, and a throttle point 3 connected to the input of evaporation component part 5 comprising;

at least one body of drying material disposed in the refrigerant flow path of the condenser component part of the circuit, said body having a shape adapted to the internal geometric shape of the condenser component part so that the drying material of said body has a drying effect on moisture in the refrigerant flowing in the condenser component part.

14. The apparatus as claimed in claim 13, comprising a filter arranged in the condenser component part downstream of the body with respect to a given direction of flow of refrigerant along the path.

15. The apparatus as claimed in claim 14, wherein the filter is an element of sintered material.

16. The apparatus as claimed in claim 13, wherein said at least one body comprises a molecular sieve.

17. The apparatus as claimed in claim 13, wherein the condenser component part defines a straight section of the flow path, and a curved section of the flow path, and said at least one body is disposed in the straight section.

18. The apparatus as claimed in claim 13, wherein each of said body is tubular and has a wall thickness less than half the diameter of the flow cross-section of the path, and an external diameter smaller than the diameter of that cross-section.

* * * * *